US009669974B2

(12) United States Patent
Wochele et al.

(10) Patent No.: US 9,669,974 B2
(45) Date of Patent: Jun. 6, 2017

(54) PROTECTIVE CAP FOR A DISPENSER, AND DISCHARGE DEVICE FOR DISCHARGING PHARMACEUTICAL AND/OR COSMETICAL LIQUIDS

(71) Applicants: Matthias Wochele, Rielasingen-Worblingen (DE); Antonio O. Mallare, Gardena, CA (US); Sai Shankar, Irvine, CA (US)

(72) Inventors: Matthias Wochele, Rielasingen-Worblingen (DE); Antonio O. Mallare, Gardena, CA (US); Sai Shankar, Irvine, CA (US)

(73) Assignee: APTAR RADOLFZELL GMBH, Radolfzell (DE)

( * ) Notice: Subject to any disclaimer, the term of this patent is extended or adjusted under 35 U.S.C. 154(b) by 145 days.

(21) Appl. No.: 14/108,449

(22) Filed: Dec. 17, 2013

(65) Prior Publication Data

US 2015/0166229 A1 Jun. 18, 2015

(51) Int. Cl.
*B65D 51/16* (2006.01)
*B65D 83/00* (2006.01)
(Continued)

(52) U.S. Cl.
CPC ..... *B65D 51/1672* (2013.01); *B65D 41/32* (2013.01); *B65D 41/48* (2013.01);
(Continued)

(58) Field of Classification Search
CPC ..... B65D 51/1672; B65D 51/1688; B65D 51/1677; B65D 41/32; B65D 41/48;
(Continued)

(56) References Cited

U.S. PATENT DOCUMENTS 3,817,416 A * 6/1974 Costa ..... B65D 47/122 215/213
4,029,231 A * 6/1977 Jonsson ..... B65D 50/045 215/224
(Continued)

FOREIGN PATENT DOCUMENTS

CN 2382677 Y 6/2000
CN 1468189 A 1/2004
(Continued)

OTHER PUBLICATIONS

English translation of Notification of Transmittal of International Search Report issued in Application No. PCT/EP2014/078048 dated Mar. 19, 2015 (1 page).
(Continued)

*Primary Examiner* — Nicholas J Weiss
(74) *Attorney, Agent, or Firm* — Flynn, Thiel, Boutell & Tanis, P.C.

(57) ABSTRACT

The invention relates to a protective cap for a dispenser, and to a dispenser for discharging pharmaceutical and/or cosmetical liquids, wherein the dispenser has a liquid reservoir and an outlet opening through which the liquid can be discharged into a surrounding atmosphere. The protective cap comprises an outer cap and an inner element inserted therein, wherein either at least one ventilation channel, which can be closed by means of a shut-off element and provides communication between an interior of the protective cap and an external environment, is formed between the outer cap and the inner element, or the inner element closes a ventilation opening of the outer cap.

10 Claims, 3 Drawing Sheets

(51) Int. Cl.

| | |
|---|---|
| ***B65D 41/32*** | (2006.01) |
| ***B65D 41/48*** | (2006.01) |
| ***B65D 47/24*** | (2006.01) |
| ***B65D 47/26*** | (2006.01) |
| ***B65D 49/08*** | (2006.01) |

(52) U.S. Cl.
CPC ..... *B65D 47/247* (2013.01); *B65D 47/265* (2013.01); *B65D 49/08* (2013.01); *B65D 51/1633* (2013.01); *B65D 51/1677* (2013.01); *B65D 51/1688* (2013.01); *B65D 83/00* (2013.01); *B65D 2205/00* (2013.01)

(58) Field of Classification Search
CPC .. B65D 47/247; B65D 47/265; B65D 47/205; B65D 49/08; B65D 83/00; B65D 2205/00; B65D 51/16; B65D 51/1633
USPC ..... 222/153.05–153.07, 206, 213; 215/307, 215/902
See application file for complete search history.

(56) References Cited

U.S. PATENT DOCUMENTS

| | | | | | |
|---|---|---|---|---|---|
| 4,427,126 | A * | 1/1984 | Ostrowsky | B65D 41/045 | 215/307 |
| 4,463,878 | A * | 8/1984 | Crone | B65D 47/128 | 215/276 |
| 4,726,482 | A * | 2/1988 | Barriac | B65D 41/3428 | 215/252 |
| 5,033,647 | A * | 7/1991 | Smith | B05B 11/0072 | 222/212 |
| 5,108,007 | A * | 4/1992 | Smith | B05B 11/0072 | 222/209 |
| 5,398,829 | A * | 3/1995 | Stubbs | B65D 41/485 | 215/201 |
| 5,785,209 | A * | 7/1998 | Guglielmini | B65D 47/043 | 222/153.07 |
| 5,853,096 | A | 12/1998 | Bartur et al. | | |
| 5,971,182 | A * | 10/1999 | Berge | B65D 41/3428 | 215/252 |
| 6,550,626 | B1 | 4/2003 | Randall | | |
| 7,188,750 | B2 * | 3/2007 | Vogel | A61J 1/1412 | 215/48 |
| 7,243,807 | B2 * | 7/2007 | Lin | B01L 3/50825 | 215/214 |
| 8,281,962 | B2 * | 10/2012 | Ogawa | B65D 47/248 | 215/329 |
| 8,794,490 | B2 * | 8/2014 | Painchaud | B65D 47/18 | 222/493 |
| 2003/0168456 | A1 * | 9/2003 | Tomasella | B65D 41/0421 | 220/257.1 |
| 2004/0011790 | A1 | 1/2004 | Woinarski | | |
| 2004/0173556 | A1 | 9/2004 | Smolko et al. | | |
| 2008/0302836 | A1 | 12/2008 | Mathis | | |
| 2010/0084364 | A1 | 4/2010 | Martin | | |
| 2010/0147899 | A1 * | 6/2010 | Nardi | B65D 47/205 | 222/420 |
| 2015/0043958 | A1 | 2/2015 | Painchaud et al. | | |

FOREIGN PATENT DOCUMENTS

| | | | |
|---|---|---|---|
| CN | 1473127 | A | 2/2004 |
| CN | 101605704 | A | 12/2009 |
| CN | 103429501 | A | 12/2013 |
| DE | 10 2011 086 755 | A1 | 5/2013 |
| FR | 2 988 015 | | 9/2013 |
| WO | WO 98/23496 | A1 | 6/1998 |
| WO | WO 2006/087740 | A1 | 8/2006 |
| WO | WO 2006/094415 | A1 | 9/2006 |

OTHER PUBLICATIONS

English translation of International Search Report issued in Application No. PCT/EP2014/078048 dated Mar. 19, 2015 (4 pages).
English translation of Written Opinion of the International Searching Authority issued in Application No. PCT/EP2014/078048 dated Mar. 19, 2015 (5 pages).
Office Action of German Patent Office issued in German Application No. 10 2014 201 697.5 dated Jun. 30, 2014 (5 pages).
English translation of Chinese Office Action issued in corresponding Chinese patent application 201480069313.0, dated Jan. 4, 2017 (7 pages).

* cited by examiner

PROTECTIVE CAP FOR A DISPENSER, AND DISCHARGE DEVICE FOR DISCHARGING PHARMACEUTICAL AND/OR COSMETICAL LIQUIDS

FIELD OF APPLICATION AND PRIOR ART

The invention relates to a protective cap for a dispenser and to a discharge device comprising a dispenser for discharging pharmaceutical and/or cosmetical liquids. A dispenser of this kind comprises a liquid reservoir and an outlet opening through which the liquid can be discharged into a surrounding atmosphere.

A liquid stored in the liquid reservoir will be conveyed for discharge in the direction of the outlet opening, which can be done using many different mechanisms. Thus, the liquid reservoir can be designed as a squeeze bottle, of which the content can be placed under pressure by deformation of the walls. A separate pump device can also be used.

Dispensers of the kind in question are known from the prior art, for example from DE 10 2011 086 755 A1. The dispenser shown in DE 10 2011 086 755 A1 comprises and an outlet channel which connects the liquid reservoir to the outlet opening, and an outlet valve is arranged in the outlet channel, which opens depending on pressure or can be manually actuated, wherein the outlet valve, in the closed state, closes the outlet channel. The outlet valve divides the outlet channel into a first portion and a second portion, wherein the second portion adjoins the outlet opening and extends in the direction of the liquid reservoir as far as the outlet valve. In other configurations, the second portion corresponds to a drop-formation surface at the outlet opening.

In each case, the outlet valve has the effect that, after it has been closed, no liquid which has passed into the second portion of the outlet channel on a side of the outlet valve directed away from the liquid reservoir, or which has remained in the area around the outlet opening outside the outlet channel, can be sucked back into the dispenser. A possible contamination of the content of the liquid reservoir by liquid residues that have been sucked back is thereby prevented. The residual liquid therefore remains in an area accessible from the outside. Contact with the atmosphere results in rapid drying of the residual liquid.

In order to permit rapid drying of the residual liquid even when a protective cap is fitted on the dispenser, it is known from DE 10 2011 086 755 A1 to provide the protective cap of the dispenser with ventilation openings that create a permanent connection between the area where a residual liquid may remain and an external environment. However, the ventilation openings for their part may again cause contamination.

In order to avoid contamination according to DE 10 2011 086 755 A1, surfaces of the outlet channel downstream of the outlet valve, as viewed in the discharge direction, and/or an outer surface of a housing surrounding the outlet opening are designed to be antibacterial, wherein the antibacterial state is limited exclusively to these surfaces.

OBJECT AND SOLUTION

The object of the invention is to make available a protective cap for a dispenser, which protective cap permits rapid drying and alleviates the problems of admission of microorganisms into the protective cap. The object of the invention is also to make available a discharge device comprising a dispenser with a corresponding protective cap.

According to a first aspect, a protective cap for a dispenser for discharging pharmaceutical and/or cosmetical liquids is provided, wherein the protective cap comprises an outer cap and an inner element inserted therein, at least one ventilation channel providing communication between an interior of the protective cap and an external environment is formed between the outer cap and the inner element, and the protective cap further comprises a shut-off element which is to be separated irreversibly from the protective cap before a first use and by means of which the at least one ventilation channel is closed in an airtight and germproof manner.

According to a second aspect, a protective cap for a dispenser for discharging pharmaceutical and/or cosmetical liquids is provided, wherein the protective cap comprises an outer cap and an inner element inserted therein, the outer cap has at least one ventilation opening for communication between an interior of the protective cap and an external environment, and the inner element is arranged to be adjustable relative to the outer cap at least between a shut-off position and a clearance position, wherein, in the shut-off position, the at least one ventilation opening is closed in an airtight and germproof manner by means of the inner element and, in the clearance position, the at least one ventilation opening connects the interior to the external environment.

According to a third aspect, a discharge device is provided comprising a dispenser for discharging pharmaceutical and/or cosmetical liquids, with a liquid reservoir and an outlet opening through which the liquid can be discharged into a surrounding atmosphere, and a protective cap with an outer cap and an inner element inserted therein, wherein at least one ventilation channel providing communication between an interior of the protective cap and an external environment is formed between the outer cap and the inner element, and with a shut-off element which is to be separated irreversibly from the protective cap before a first use and by means of which the at least one ventilation channel is closed in an airtight and germproof manner.

According to a fourth aspect, a discharge device is provided comprising a dispenser for discharging pharmaceutical and/or cosmetical liquids, with a liquid reservoir and an outlet opening through which the liquid can be discharged into a surrounding atmosphere, and a protective cap with an outer cap and an inner element inserted therein, wherein the outer cap has at least one ventilation opening for communication between an interior of the protective cap and an external environment, and the inner element is arranged to be adjustable relative to the outer cap at least between a shut-off position and a clearance position, wherein, in the shut-off position, the at least one ventilation opening is closed in an airtight and germproof manner by means of the inner element and, in the clearance position, the at least one ventilation opening connects the interior to the external environment.

Rapid drying of the residual liquid is achieved by virtue of the communication between the interior of the protective cap and the external environment. The invention is also based on the knowledge that, before a first use and during storage, transport, etc., germs can gather on the protective cap over the course of time. The quantity of germs that have gathered is dependent, among other things, on the period of time before a first use and on a microbial burden of the environment. If germs are left to gather, this can lead to germs entering the interior of the protective cap via a ventilation opening.

Germs within the meaning of the present invention are to be understood as all microbial pathogens, in particular bacteria and viruses. In the context of the application, a germproof and airtight closure or a germproof and airtight seal is to be understood as a seal with which there is a leakage rate of less than or equal to $10^{-6}$ mbar l/s during storage of the dispenser under normal or standard conditions. A test of impermeability to germs is carried out, for example, in accordance with DIN 58953. In other embodiments, the sealing element is designed in such a way that the provisions of standards DIN EN ISO 11607, DIN EN 868 are met.

The dispenser is suitable in particular for unpreserved ophthalmic agents. In one embodiment, the dispenser comprises an outlet channel, which connects the liquid reservoir to the outlet opening, and an outlet valve arranged in the outlet channel, which opens depending on pressure or can be manually actuated and which is arranged in the outlet channel and, in a closed state, closes the outlet channel. The outlet valve prevents entry of germs into the liquid reservoir. The outlet valve is preferably an outlet valve which opens depending on pressure and which is opened by the pressure of the liquid in the liquid reservoir, or of a partial amount removed therefrom, and which automatically closes again as soon as the corresponding overpressure with respect to the environment ends. However, other types of valves can also be used here in principle. For example, provision can be made that the liquid in the liquid reservoir is permanently under pressure and the dispenser is maneuvered via a handle, of which the manual actuation opens the outlet valve. The outlet valve prevents discharged liquid from being sucked back into the liquid reservoir.

According to the first aspect, a sealable ventilation channel is formed between the outer cap and the inner element. A simple design of the ventilation channel is possible in this way. In one embodiment, the ventilation channel is formed by grooves on an inner surface of the outer cap and/or an outer surface of the inner element, which grooves are closed upon connection of the parts in the radial direction. The shape, size and/or profile of the grooves will be chosen as suitable for a specific use. In one embodiment, provision is made that the grooves extend in the longitudinal direction of the outer cap. In other embodiments, the grooves extend in a helical shape between the outer cap and the inner element. In advantageous embodiments, provision is made that the outer cap comprises a sleeve-shaped portion and a cover portion connected to the latter. In advantageous embodiments, the inner element is designed as an inner sleeve, which is inserted into the sleeve-shaped portion. In other embodiments, the inner element is likewise designed as a cap with a cover portion, wherein a through-opening is provided for communication between the interior and the ventilation channel.

In one embodiment, a ventilation channel is formed which is divided by means of the shut-off element into a first portion communicating with the interior and a second portion communicating with the environment. In advantageous embodiments, the shut-off element, before a removal, closes a mouth of a ventilation channel. In one embodiment, a plurality of ventilation channels are provided in order to ensure sufficient ventilation of the interior after removal of the shut-off element, which ventilation channels all open out in an area of the shut-off element and are thus all closed by a common shut-off element.

In one embodiment, the protective cap comprises a tamper-evident safety device with a first segment which is to be removed irreversibly before a first use, wherein the first segment to be removed serves as shut-off element, and the at least one ventilation channel is closed in an airtight and germproof manner by means of the first segment before a removal of the first segment.

By virtue of the tamper-evident safety device to be at least partially removed, more precisely the first segment to be removed irreversibly before a first use, entry of germs into the interior of the protective cap via the at least one ventilation channel before a first use is prevented, without special precautions having to be taken for this purpose as regards storage, transport, etc. In other words, before a first use, the tamper-evident safety device prevents germs from already gathering over the course of time on the dispenser and in the interior of the protective cap during storage, transport, etc. Before a first use, the tamper-evident safety device has to be removed, since it otherwise prevents use of the dispenser, in particular it prevents pulling-off of the protective cap from the dispenser. The first segment is removed irreversibly. In a subsequent use of the protective cap, a communication between the interior and an external environment is thus provided via the ventilation channel, in order to permit rapid drying of the residual liquid. On account of a short period of use of the dispenser, possible entry of germs after the first use is not generally critical.

In advantageous embodiments, the tamper-evident safety device has the first segment and also a second segment, wherein the first segment is connected to the second segment and to the outer cap by means of predetermined breaking points. The segments are each preferably designed as an annular element surrounding the dispenser. The first segment preferably has a tear-open tab. In advantageous embodiments, the second segment has latching elements for latching onto the dispenser, wherein the latched connection can be undone only with destruction of the tamper-evident safety device and/or of the dispenser or parts thereof. In other embodiments, the second segment is integrally bonded to the dispenser, such that a separation is possible only with destruction. In the context of the application, destruction also designates a visible deformation or the like. As a result of the destruction, it is in any case apparent to the user that the dispenser is not in its original state and that the quality of the stored liquid is not guaranteed.

In advantageous embodiments, the segments and the outer cap are formed in one piece, for example as an injection-molded part. In other embodiments, individual elements are provided which are connected at the predetermined breaking points.

In advantageous embodiments, the first segment of the tamper-evident safety device bears in an airtight and germproof manner sealingly on a housing of the dispenser, in particular on a housing of an outlet assembly. An outlet assembly is an assembly that can be mounted on a liquid reservoir and that comprises the outlet opening and—if any—the outlet valve. In one embodiment, impermeability to air and germs is afforded by a clamping force between the housing and the first segment, wherein the clamping force is preferably applied by restoring forces of an elastically deformed segment and/or housing. In other embodiments, elastic sealing elements are provided between the segment and the housing.

In an advantageous embodiment, the inner element has two sealing areas which are spaced apart in the axial direction and which make contact with the dispenser. A design of this kind is particularly advantageous for a dispenser with a pressure compensation opening for the liquid reservoir, via which opening the liquid reservoir communicates with the environment for pressure compensation. During a use of the protective cap, the pressure compensation opening is arranged between the two sealing areas, such that the pressure compensation opening is sealed off both with respect to the environment and also to the outlet opening (and thus indirectly also to the environment). A drying-out and/or an entry of germs via the pressure compensation opening are thus prevented.

According to the second aspect, the inner element is adjustable relative to the outer cap, in particular rotatable about the longitudinal axis, and in one position it closes a ventilation opening of the outer cap, via which opening an interior of the outer cap communicates with the environment. In one embodiment, the ventilation opening is designed as a ventilation channel, and in other embodiments as an aperture in a wall of the protective cap. In one embodiment, for obtaining an inner element that is rotatable about the longitudinal axis relative to the protective cap, an inner sleeve or an inner cap is provided which is inserted in the outer cap so as to rotate about the longitudinal axis relative to the outer cap. In advantageous embodiments, a rotation movement from a shut-off position, in which the at least one ventilation opening is closed in an airtight and germproof manner by means of the inner element, to a clearance position, in which the at least one ventilation opening connects the interior to the external environment, is irreversible. After the inner element has been rotated to the clearance position, the interior is thus connected permanently to the environment via the ventilation openings.

In one development, the protective cap has an absorber element that rests on the outlet opening during use. The absorber element assists in drying the dispenser by taking up and spreading the residual drop. The absorber element is designed, for example, as a sponge-like element, woven fabric or membrane.

BRIEF DESCRIPTION OF THE DRAWINGS

Further advantages and aspects of the invention will become clear not only from the claims but also from the following description of preferred illustrative embodiments of the invention, which are explained below with reference to the figures. The same reference signs are used in the drawings for identical or similar components. Features described or shown as part of one illustrative embodiment can likewise be used in another illustrative embodiment in order to obtain a further configuration of the invention. In the drawings:

DETAILED DESCRIPTION OF THE ILLUSTRATIVE EMBODIMENTS

Figure 1:
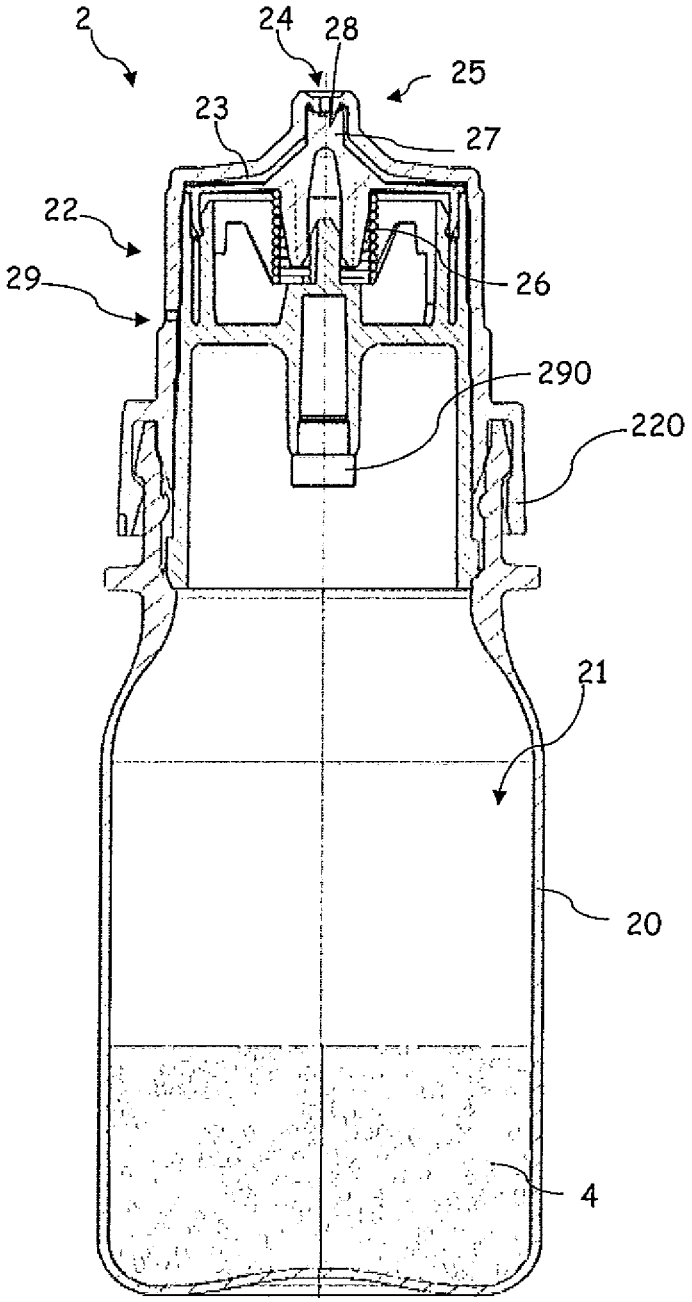
FIG. 1 shows a cross-sectional view of a dispenser for discharging pharmaceutical and/or cosmetical liquids.

FIG. 1 first shows a dispenser 2 for discharging pharmaceutical and/or cosmetical liquids, which dispenser is suitable in particular for unpreserved ophthalmics.

This dispenser 2 has a liquid reservoir 21 delimited by a container body 20. The liquid 4 is stored in the liquid reservoir 21. An outlet assembly 22 with a housing 220 is mounted on the container body 20, wherein the housing 220 in the illustrative embodiment shown is secured on the container body 20 by means of a latching connection. This outlet assembly 22 serves the purpose of conveying liquid from the liquid reservoir 21 through an outlet channel 23 to an outlet opening 24. The outlet opening 24 shown is designed as a drop-formation surface and widens conically in the discharge direction.

In the view in FIG. 1, the sectional plane means that only a final portion of the outlet channel 23 is shown. Arranged in the outlet channel 23 is an outlet valve 25 which, in a closed state, closes the outlet channel 23, such that liquid located downstream of the outlet valve 25 in the discharge direction cannot pass back into the liquid reservoir 21. The outlet valve 25 shown comprises a valve body 27, which is adjustable counter to the force of a restoring spring 26 and which cooperates with a valve seat 28 formed on a housing wall. An inward flow of air into the liquid reservoir 21 for pressure compensation takes place via a pressure compensation opening 29 and a filter element 290, wherein the pressure compensation opening 29 communicates with the filter element 290 via a channel (not shown). In advantageous embodiments, the filter element 290 comprises a liquid filter pointing toward the liquid reservoir 21, and a bacterial filter pointing away from the liquid reservoir 21 and having a separation limit of ca. 0.2 μm, such that bacteria measuring ca. 0.2 to ca. 5 μm are safely held back by the bacterial filter.

The dispenser 2 shown is designed as a squeeze bottle. This dispenser 2 is used by turning it over with the outlet opening 24 facing downward. Walls of the container body 20 are then squeezed together in order to apply pressure to the liquid 4 in the liquid reservoir 21. This pressure causes the outlet valve 25 to open. More exactly, as soon as the liquid pressure in a portion of the outlet channel 23 upstream of the outlet valve 25 is high enough, the valve body 27 is shifted by this pressure counter to the force of the restoring spring 26 and clears the way for the liquid in the direction of the outlet opening 24.

After a discharge, the outlet valve 25 is closed again. Generally, a residue of the liquid, the so-called residual drop, remains on the outlet opening 24, designed as drop-formation surface, and in a portion of the outlet channel 23 assigned to the outlet opening 24 and downstream of the outlet valve 25 in the discharge direction. A return flow into the liquid reservoir 21 is not possible on account of the outlet valve 25 that opens depending on pressure. Without fitting a protective cap, the residual drop can quickly dry up.

Figure 2:
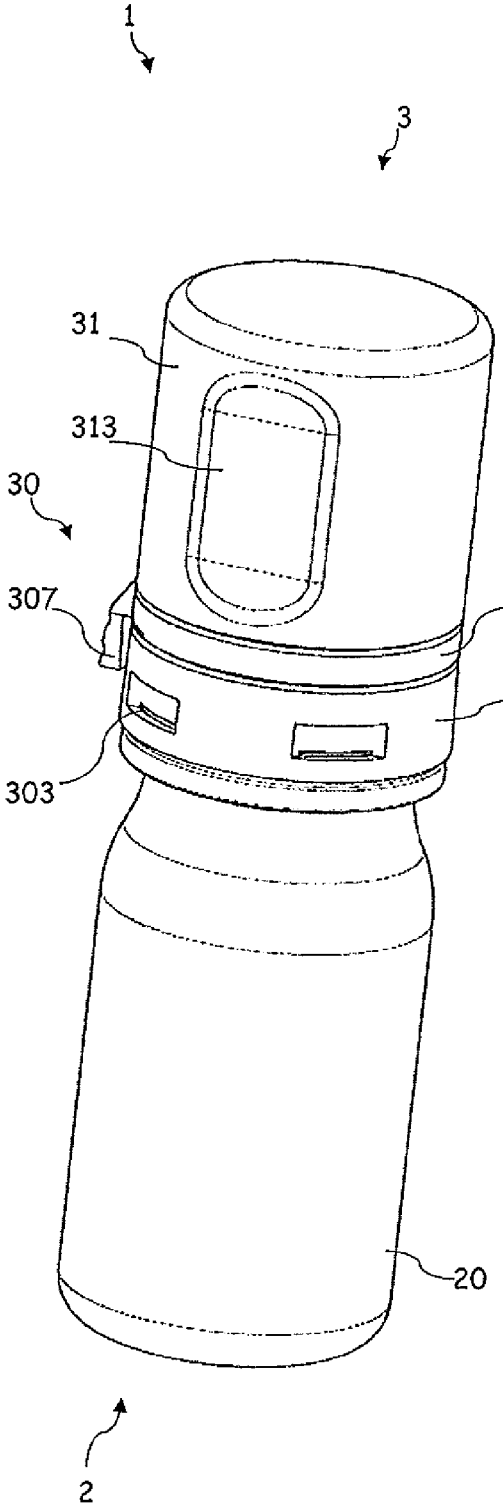
FIG. 2 shows a perspective overall view of a first embodiment of a discharge device comprising a dispenser and a protective cap.
Figure 3:
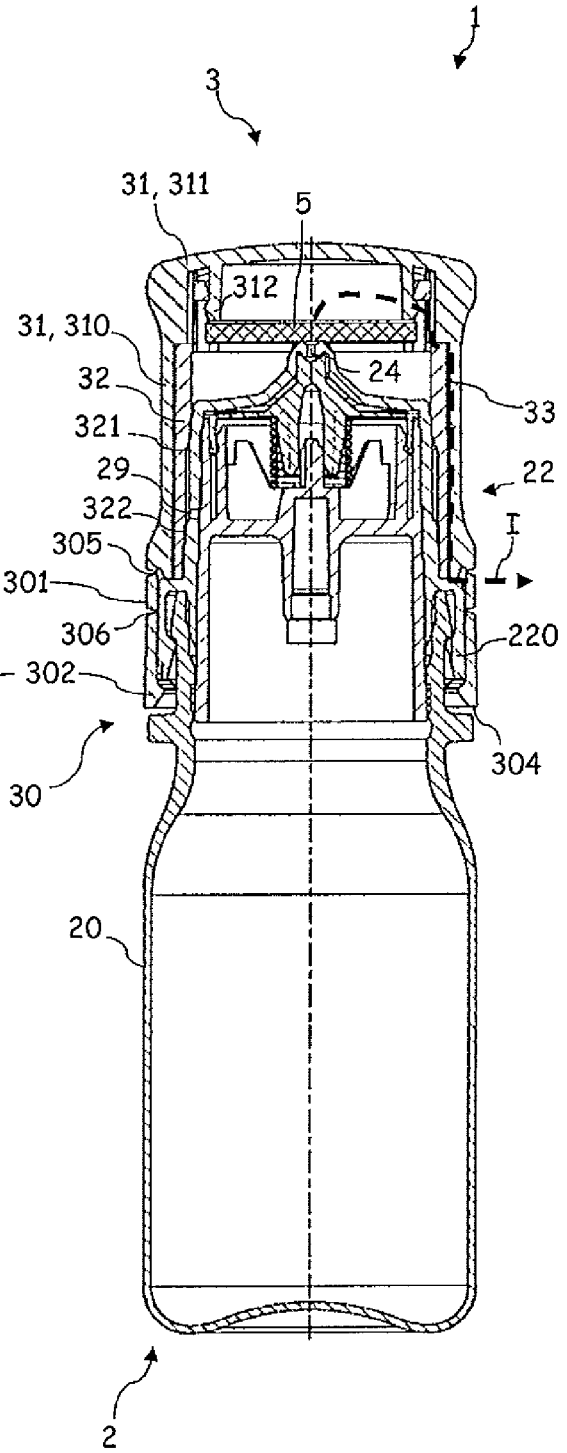
FIG. 3 shows a cross-sectional view of the discharge device according to FIG. 2.

FIGS. 2 and 3 show a perspective overall view and a sectional view, respectively, of a first embodiment of a discharge device 1 comprising a dispenser 2 according to FIG. 1 and a protective cap 3 with an irreversibly removable shut-off element. For a description of the dispenser 2, reference is made to the above.

The protective cap 3 has a tamper-evident safety device 30, an outer cap 31 formed in one piece with the tamper-evident safety device 30, and an inner element 32 inserted into the outer cap 31. Between the outer cap 31 and the inner element 32 inserted therein, a ventilation channel 33 is formed so as to bring an interior of the protective cap 3 into communication with an external environment and thus permit rapid drying even when a protective cap 3 is fitted. An air stream through the ventilation channel 33 is indicated schematically by an arrow I. The ventilation channel 33 is formed preferably by a channel or groove on the outer cap 31 and/or on the inner element 32, which channel or groove is closed by the second element. In one embodiment, a multiplicity of channels or grooves are provided which extend in the axial direction of the dispenser 2 and which form a multiplicity of parallel ventilation inserted.

The outer cap 31 has a sleeve-shaped portion 310 and a cover element 311. The inner element 32 shown is designed as an inner sleeve. The inner sleeve is inserted into the sleeve-shaped portion 310 of the outer cap 31 and is latched onto the outer cap 31 at an end directed away from the container body 20. In the illustrative embodiment shown, the outer cap 31 for this purpose has an annular web 312 protruding from the cover element 311. The web 312 forms, with the sleeve-shaped portion 310, a slit into which an end of the inner sleeve is inserted.

At the end of the inner element 32 directed away from the container body 20, an absorber element 5 is also provided which, as is shown, rests on the outlet opening 24 during a use of the protective cap, wherein the absorber element 5 closes the inner element 32 in an air-permeable manner in the direction of the ventilation channel 33.

The tamper-evident safety device 30 shown has a first segment 301 to be removed irreversibly before a first use, and a second segment 302 connected to the dispenser 2 such that the connection cannot be undone without destruction. In the illustrative embodiment shown, the second segment 302 has slits 303 into which detent springs (not shown) of the dispenser 2, more precisely of the housing 220 of the outlet assembly 22, engage. The detent springs are designed in such a way that, during a movement in a fitting direction when mounting the protective cap 3 onto the outlet assembly 22, the detent springs are latched into the slits 303, wherein the detent springs, after latching, prevent a movement counter to the fitting direction. A movement of the second segment 302 and thus of the outer cap 31 for detachment of the protective cap 3 is thus possible only with at least partial destruction of the second segment 302 and/or of the detent springs. If detachment of this kind takes place improperly, this is therefore immediately apparent from the partial destruction of the component parts. In other embodiments, other elements are provided for connecting the second segment 302 to the outlet assembly 22 such that the connection cannot be undone without destruction. In the illustrative embodiment shown, the second segment 302 is additionally connected to the housing 220 by a latching geometry 304.

The first segment 301, the second segment 302 and the outer cap 31 are formed in one piece, wherein the first segment 301 is arranged between the second segment 302 and the outer cap 31. The first segment 301 is connected to the outer cap 31 and to the second segment 302 by means of predetermined breaking points 305, 306. On the first segment 301, there is also a tear-open tab 307 that can be gripped by a user, and, by application of a force on the tear-off tab 307, the first segment 301 is separated at the predetermined breaking points 305, 306 from the outer cap 31 and from the second segment 302 and thus removed irreversibly. After removal of the first segment 301, the second segment 302 remains on the housing 220 but is no longer connected to the outer cap 31. The protective cap 3 can thus be detached after removal of the first segment 301. The protective cap 3 is designed in such a way that said cap 3 can be repeatedly detached from and clamped back onto the dispenser 2. For this purpose, the protective cap 3 is slightly deformed when fitted, such that the elastic restoring forces of a protective cap 3 made from plastic generate a clamping action. In other embodiments, latching elements are provided for this purpose. The outer cap 31 has grip areas 313 to allow better gripping and better application of a force.

The first segment 301 serves as a shut-off element and, in the original state shown in FIGS. 2 and 3, i.e. before a removal of the first segment 301, the ventilation channel 33 is closed in an airtight and germproof manner by the first segment 301. For this purpose, the first segment 301 bears sealingly on the housing 220. This prevents germs from collecting in an interior of the protective cap 3 before a first use. After the first segment 301 has been removed, the ventilation channel 33 or ventilation channels are cleared, thereby ensuring that the outlet opening 24 dries off.

The inner element 32 shown also has two sealing areas 321, 322 which are spaced apart in the axial direction and at which the inner element 32 bears sealingly on the housing 220. As can be seen from FIG. 3, the pressure compensation opening 29 is arranged between the sealing areas 321, 322 during a use of the protective cap 3. With the protective cap 3 fitted in place, the pressure compensation opening 29 is thus sealed off both from the environment and also from the outlet opening 24. Diffusion of the liquid 4 is thereby prevented.

Figure 4:
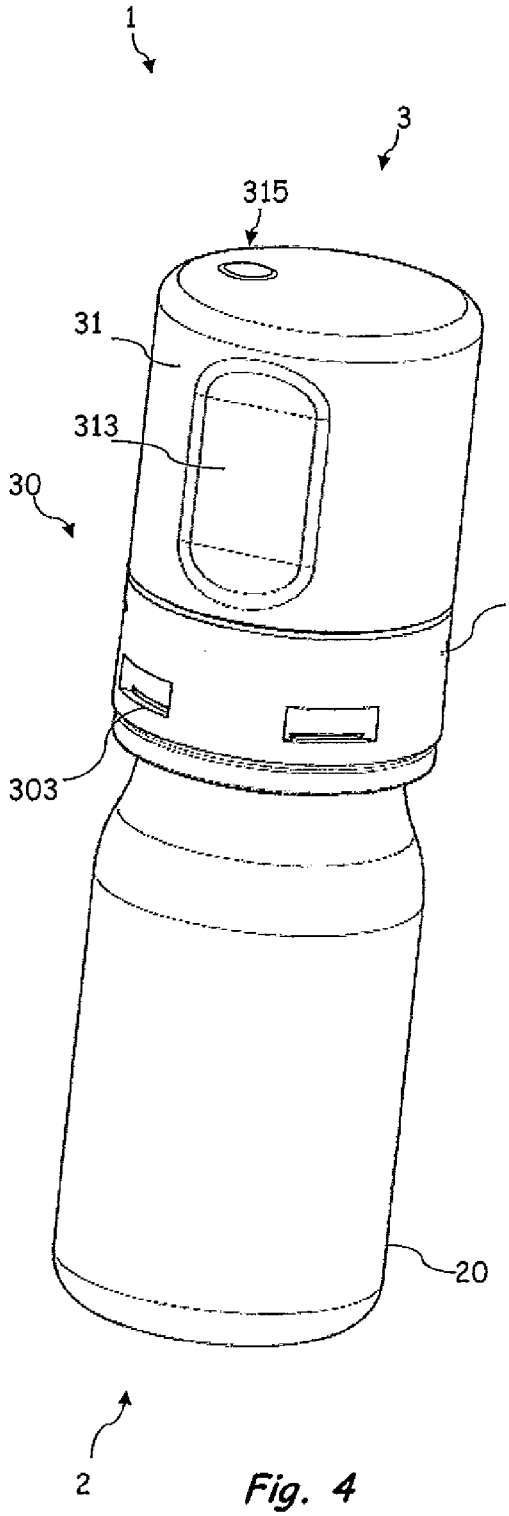
FIG. 4 shows a perspective overall view of a second embodiment of a discharge device comprising a dispenser and a protective cap.
Figure 5:
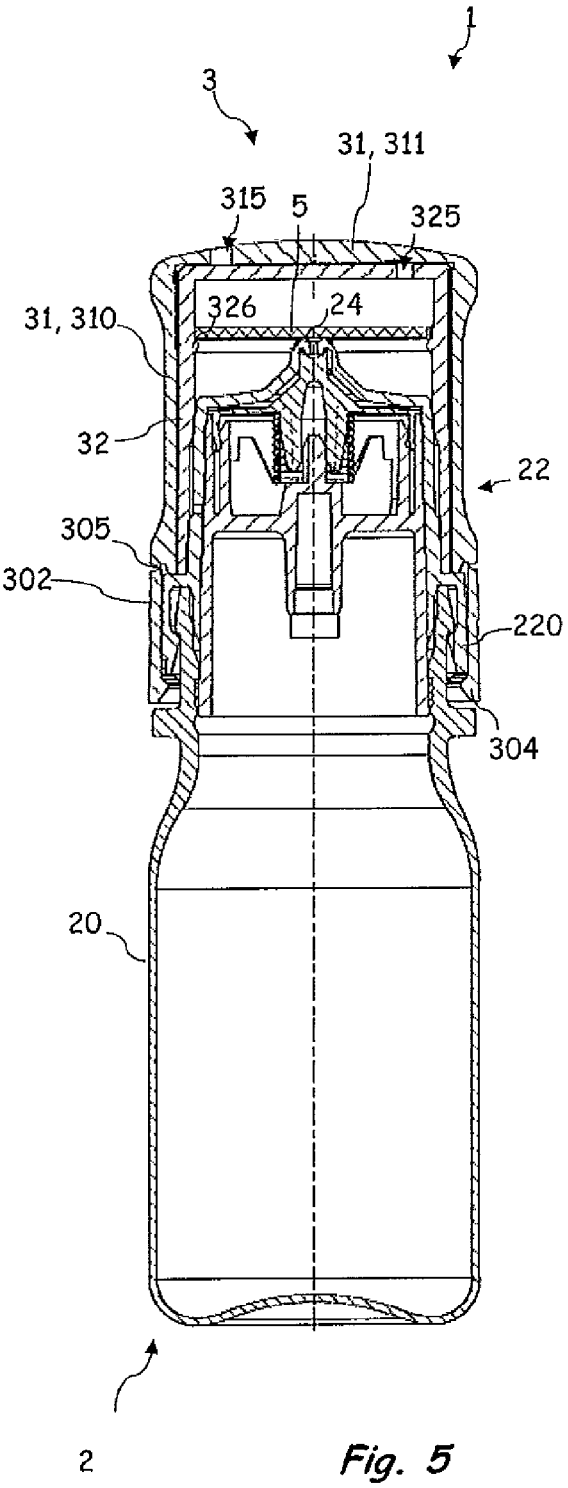
FIG. 5 shows a cross-sectional view of the discharge device according to FIG. 4.

FIGS. 4 and 5 show a perspective overall view and a sectional view, respectively, of a second embodiment of a discharge device 1 comprising a dispenser 2 according to FIG. 1 and a protective cap 3, with an inner element 32 that is rotatable relative to the protective cap. The protective cap 3 is used similarly to the protective cap 3 in FIGS. 2 and 3, and the same reference signs are used for identical or similar components. For a description of the dispenser 2, reference is made to the above.

The protective cap 3 has a tamper-evident safety device 30, and an outer cap 31 formed in one piece with the tamper-evident safety device 30. The outer cap 31 has a sleeve-shaped portion 310 and a cover element 311. The inner element 32 shown in FIGS. 4 and 5 is designed as an inner cap and is inserted into the sleeve-shaped portion 310 of the outer cap 31.

The outer cap 31 and the inner element 32 designed as an inner cap each have an aperture 315, 325. If the apertures 315, 325 are brought into coincidence, an interior of the protective cap 3 communicates with an external environment via the apertures 315, 325, in order thereby to permit rapid drying of a residual liquid even when the protective cap 3 is fitted in place. In the state shown, the apertures 315, 325 are not coincident, and an interior of the protective cap 3 is closed in an airtight and germproof manner.

At an end of the inner element 32 directed away from the container body 20, an absorber element 5 is provided which, as is shown, bears on the outlet opening 24 during a use of the protective cap. The absorber element 5 is locked onto the inner element 32 by means of a peripheral projection 326.

The tamper-evident safety device 30 shown in FIGS. 4 and 5 has a segment 302 which is connected to the dispenser 2 in such a way that the connection cannot be undone without destruction, and which prevents detachment of the protective cap 3. The segment 302 is secured on the housing 220 analogously to the embodiment according to FIGS. 2 and 3, and reference is made to the above for a description. The segment 302 and the outer cap 31 are formed in one piece, wherein a predetermined breaking point 305 is provided between the segment 302 and the outer cap 31. By application of a torque on the outer cap 31, the outer cap 31 is separated from the first segment 301 at the predetermined breaking points 305. The outer cap 31 is adjusted relative to the inner element 32, to be more exact rotated about the longitudinal axis, such that the apertures 315, 325 come into coincidence. Preferably, it is possible to pull off the protective cap 3 only when the apertures 315, 325 have come into coincidence. Grip areas 313 are provided to allow better gripping of the outer cap 31.

The invention claimed is:

1. A protective cap for a dispenser for discharging a pharmaceutical and/or cosmetical liquid having a liquid reservoir and an outlet opening through which the liquid can be discharged into a surrounding atmosphere, the protective cap comprising:

an outer cap and an inner element inserted therein;

at least one ventilation channel providing communication between an interior of the protective cap and an external environment formed between the outer cap and the inner element; and a tamper-evident safety device with a first segment which is to be removed irreversibly before a first use, wherein the first segment to be removed serves as a shut-off element which is to be separated irreversibly from the protective cap before the first use and by which the at least one ventilation channel is directly closed in an airtight and germproof manner by the first segment before removal of the first segment, wherein the shut-off element directly prevents airflow through the at least one ventilation channel before removal of the shut-off element.

2. The protective cap as claimed in claim 1, wherein the tamper-evident safety device has the first segment and a second segment, wherein the first segment is connected to the second segment and to the outer cap by predetermined breaking points.

3. The protective cap as claimed in claim 1, wherein the inner element has two sealing areas which are spaced apart in an axial direction and are for providing contact with the dispenser.

4. The protective cap as claimed in claim 1, wherein the protective cap has an absorber element that rests on the outlet opening during use.

5. A discharge device comprising:

a dispenser for discharging a pharmaceutical and/or cosmetical liquid, the dispenser including a liquid reservoir and an outlet opening through which the liquid can be discharged into a surrounding atmosphere; and a protective cap with an outer cap and an inner element inserted therein, wherein at least one ventilation channel providing communication between an interior of the protective cap and an external environment is formed between the outer cap and the inner element, and a tamper-evident safety device with a first segment which is to be removed irreversibly before a first use, wherein the first segment to be removed serves as a shut-off element which is to be separated irreversibly from the protective cap before the first use and by which the at least one ventilation channel is directly closed in an airtight and germproof manner by the first segment before removal of the first segment, wherein the shut-off element directly prevents airflow through the at least one ventilation channel before removal of the shut-off element.

6. The discharge device as claimed in claim 5, wherein the first segment, before a removal, bears sealingly in the airtight and germproof manner on a housing of the dispenser such that the at least one ventilation channel is directly closed in the airtight and germproof manner by the first segment before removal of the first segment.

7. The discharge device as claimed in claim 5, further comprising an outlet channel, which connects the liquid reservoir to the outlet opening, and an outlet valve, which opens depending on pressure or can be manually actuated and which is arranged in the outlet channel and, in a closed state, closes the outlet channel.

8. The discharge device as claimed in claim 5, wherein the shut-off element is connected to the outer cap by predetermined breaking points.

9. A protective cap for a dispenser comprising:

an outer cap and an inner element inserted therein;

at least one ventilation channel providing communication between an interior of the protective cap and an external environment formed between the outer cap and the inner element; and a tamper-evident safety device with a first segment which is to be removed irreversibly before a first use of the protective cap, wherein the first segment to be removed serves as a shut-off element which is to be separated irreversibly from the protective cap before the first use and by which the at least one ventilation channel is directly closed in an airtight and germproof manner while the shut-off element is connected to the protective cap;

wherein the shut-off element directly prevents airflow through the at least one ventilation channel before removal of the shut-off element.

10. The protective cap of claim 9, wherein the shut-off element is connected to the outer cap by predetermined breaking points.

* * * * *